US005823588A

United States Patent [19]

Morghen

[11] Patent Number: 5,823,588

[45] Date of Patent: Oct. 20, 1998

[54] UNIVERSAL HOIST ASSEMBLY

[76] Inventor: Manfred A. Morghen, 6924 Hyde Park Dr., No. 200, San Diego, Calif. 92119

[21] Appl. No.: 556,007

[22] Filed: Nov. 13, 1995

[51] Int. Cl.[6] ..... B66C 1/66

[52] U.S. Cl. ..... 294/1.1; 294/89; 403/164

[58] Field of Search ..... 294/1.1, 82.1, 294/89; 403/60, 76–78, 164; 410/101

[56] References Cited

U.S. PATENT DOCUMENTS

| | | | |
|---|---|---|---|
| 2,812,971 | 11/1957 | Teutsch | 294/1.1 |
| 3,888,190 | 6/1975 | Bigge | 410/101 |
| 4,074,519 | 2/1978 | Garrett | 294/1.1 |
| 4,699,410 | 10/1987 | Seidel | 294/1.1 |
| 5,248,176 | 9/1993 | Fredriksson | 294/89 |
| 5,381,650 | 1/1995 | Garrett | 403/78 |

FOREIGN PATENT DOCUMENTS

| | | | |
|---|---|---|---|
| 3400-351 | 7/1985 | Germany | 294/1.1 |

*Primary Examiner*—Dean Kramer

[57] ABSTRACT

A universal hoist assembly for lifting large, heavy, structures. The assembly basically includes a housing which captures the base of a lift swivel while permitting free rotation of the base. An upright extension of the base extends out of the housing and has a transverse aperture through which a shackle is fastened. This arrangement permits the shackle to pivot and the extension to freely rotate, so that a lift can be conducted with structures of widely varying configurations without danger from sideloads on the lift assembly. Preferably, the base is either disk-shaped and housed in a corresponding recess for rotation in a plane or has a spherical exterior shape in a corresponding recess to permit rotation plus pivoting in any direction. The assembly may be fastened to a structure by a single central threaded bolt fastened to the housing and threaded into the structure or extending through a structure wall to a nut or by several spaced bolts. Two housings may be secured to a structure in a spaced relationship with a single shaft extending through apertures at the housings and a shackle on the shaft intermediate the housings.

19 Claims, 4 Drawing Sheets

UNIVERSAL HOIST ASSEMBLY

BACKGROUND OF THE INVENTION

This invention relates in general to hoist ring assemblies for lifting large, heavy, structures and, more specifically, to a universal hoist ring assembly having improved versatility, strength and efficiency.

A very wide range of devices have been developed to permit safe lifting of very large structures during manufacture or installation, such as large aircraft subassemblies, ship hull panels, large machines or machine components, etc. These devices range from simple eyebolts through shackles to hoist rings and custom clamps. Extreme care must be used in selecting and using a hoisting device for a particular structure. Breaking a lifting device through misuse or overloading can allow a multi-ton structure to fall, with severe damage to the structure and the surrounding area, in addition to possible severe injuries to workers.

Simple eye bolts and similar connections are only suitable with a lift line lying precisely along the length of the bolt. Any side loading is likely to result in catastrophic failure of the bolt. Because of this, shackles that pivot in one plane are used where the load direction may vary along a single plane. Shackles are often used with chain or rigging lines to attach fittings or to suspend a line. Where the load direction will vary in one plane, a hinged hoist ring may be used to accommodate the changing load direction. Typical of such hoist rings is that disclosed in U.S. Pat. No. 4,557,513. These hoist rings cannot, however, accommodate loads from any direction other than along the hinging plane.

When large, irregularly shaped structures such as aircraft panels or ship hull panels must be lifted, the lift load line will be in a direction well away from the fitting attachment bolt centerline and may vary in several different directions during the lift. Fully swiveling hoist rings, typically having rotating bases with a hinged ring, are used in such applications. Typical of such swiveling rings are those described in U.S. Pat. Nos. 3,297,293 and 4,705,422. These rings are very useful within their lift weight ratings.

Present swiveling lift rings, such as those described in the mentioned patents, tend to be complex and heavy and to have relatively low safe-load ratings. The separately installed shoulder pins and rings used as a unit often do not have the required load rating. Most are fastened to the structure to be lifted by a single bolt. In some applications it is desirable, as an additional safety measure, to attach the hoist ring assembly to the structure by two or more bolts while retaining the full swiveling and pivoting capability. A hoist ring assembly must fully and safely satisfy load and stress strength requirements from various angles and directions and under often adverse conditions.

Thus, there is a continuing need for improved hoist assemblies that are more versatile, have higher load ratings without excessive weight, and are simple and inexpensive to manufacture and use.

SUMMARY OF THE INVENTION

The above-noted problems, and others, are overcome in accordance with this invention by a universal hoist ring assembly that basically comprises a housing, means for securing one side of the housing to a structure, a lift swivel having a base captured in said housing and rotatable relative thereto, an upright extension on the base extending from the housing opposite the securing means, a transverse aperture in the extension and a generally U-shaped shackle having a shaft, such as a bolt, passing though the legs and the extension aperture.

The shackle can pivot in a plane about the shaft and rotate over 360° with the lift extension about the base within the housing. In a first embodiment, the base is disk-shaped and rotatable in a correspondingly-shaped cavity in the housing.

In a second embodiment the base has a spherical exterior configuration and is captured in a correspondingly spherical hollow in the interior of the housing. In this case, the shackle can pivot and the base can rotate as before, and in addition the base, extension and shackle can tilt to a selected degree in any direction. This increases the versatility of the assembly, particularly where a structure may shift somewhat during a lift.

A third embodiment has particular utility where it is desired to space the structure attachment points apart. This may be necessary where the structure is such that securely fastening the housing to the structure is difficult or where the attachment is inherently weak such as where attachment must be made to thin walls of relatively low strength material. Two separate housings, each having a captured base and apertured extension as described above are secured to a structure to be lifted in a spaced apart arrangement. An elongated shaft passes through one apertured extension, through the legs of a shackle then through the second apertured extension. Suitable means, such as shaft collars, are used adjacent to each apertured extension and at the shackle to position the shaft relative to those components. The lift point is, thus, midway between two housings, providing twice the attachment strength between housings and structure.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 2:
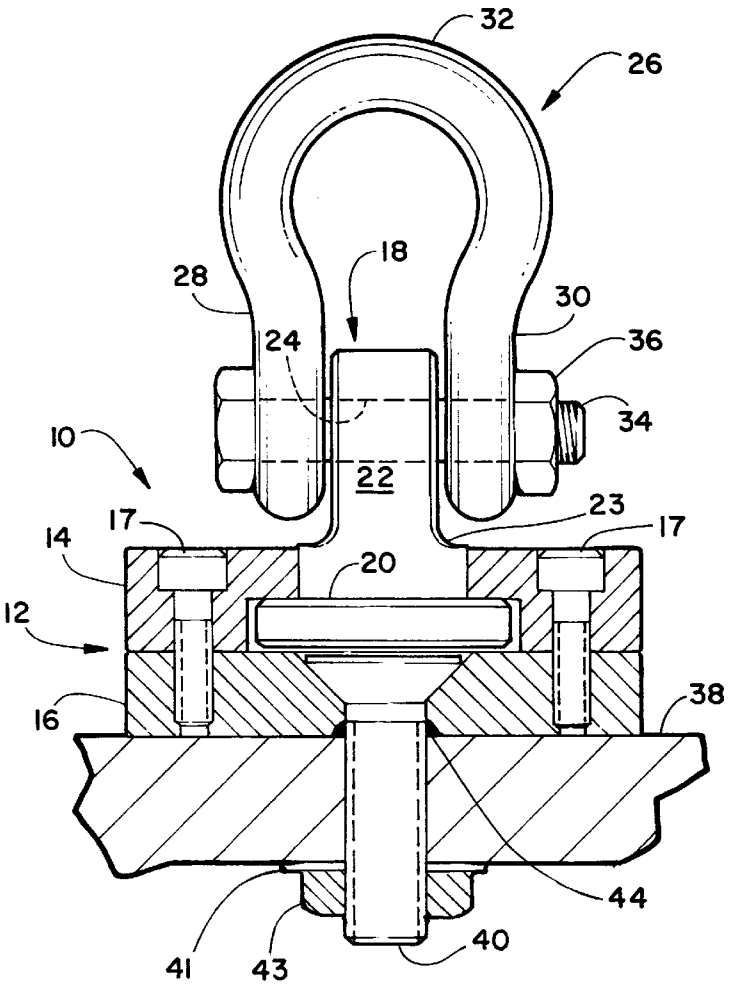
FIG. 2 is a section view of the assembly of FIG. 1, taken on line 2—2 in FIG. 1.
Figure 1:
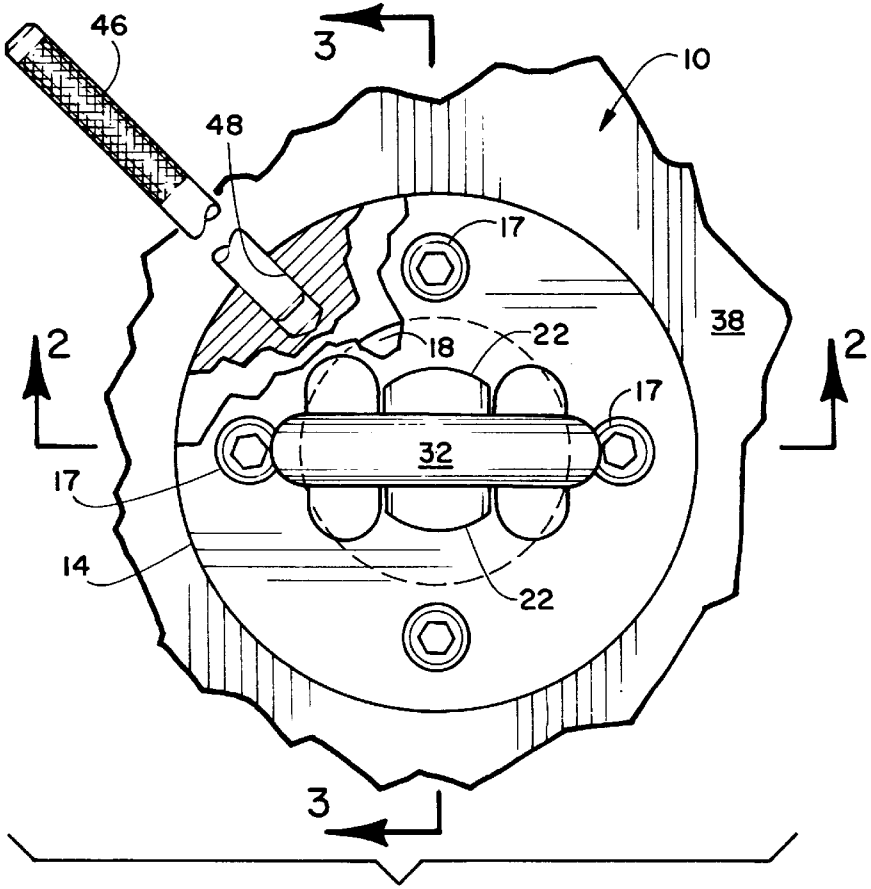
FIG. 1 is a plan view of a universal hoist assembly.
Figure 3:
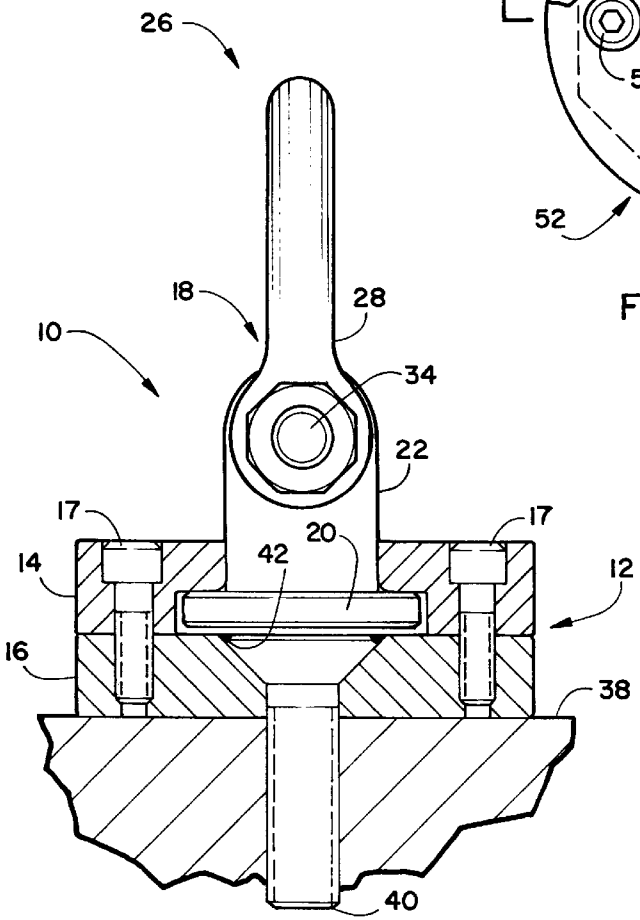
FIG. 3 is a section view of the assembly of FIG. 1, taken on line 3—3 in FIG. 1.

Referring to FIGS. 1–3, there is seen a universal hoisting assembly 10 including a housing 12 having an upper plate 14 and lower plate 16, held together with a suitable means, such as the machine bolts 17 to permit assembly and disassembly. The lower surface of lower plate 16 is configured to conform to the surface onto which the assembly is to be fastened. While many such surfaces will be flat, concave or convex surfaces can be accommodated by a correspondingly shaped lower plates 16. A kit for use with the lift assembly may include a number of lower plates 16 for use with the usual structures to be moved in a particular factory or the like. Often, very precise plates 16 can be made using the same numerical control programing as was used to generate the structure being lifted. Components of the hoist assembly may be formed from any suitable material, such as forged high strength alloy steel, stainless steel, etc.

A lift swivel 18 includes a base 20, disk-shaped in this embodiment, and an upright extension 22 having an aperture 24 therethrough. Base 20 and extension 22 may be formed in any suitable manner, such as forging and/or machining from a single piece, machining separately and welding together, etc. Typically, a shoulder 23 on base slip-fits in a corresponding round opening in upper plate 14. Thus, while a circular base 20 in a corresponding, slightly oversize, cavity is preferred, if desired base could have another shape so long as clearance is provided in the cavity and the material strength integrity is not compromised.

In some cases, it may be desirable to have the ability to lock lift swivel 18 to housing 12 to prevent further rotation of the swivel. Threaded holes may be formed through upper plate 14, parallel to the upper surface of the upper plate and between bolts 17, terminating at shoulder 23. Then, set-screws may be threaded into the hole into engagement with shoulder 23 to lock housing 12 and lift swivel 18 together.

Base 20 is rotatable in the recess seen in upper plate 14. In order to ease rotation, any suitable lubricant may be used. Washer-type low friction bearings and dry lubricants are preferred.

A generally conventional high-strength shackle 26, having two apertured legs 28 and 30 and an upper cross piece 32 is held to extension 22 by a shaft 34, in the embodiment shown a bolt, which extends through the shackle and extension. Any other suitable shaft may be used, such as a cylindrical shaft having cotter pins or the like extending through transverse holes in the shaft ends just outside legs 28 and 30. Where shaft 34 is a bolt, a conventional nut 36 will be used to capture the bolt while allowing shackle 26 to freely pivot around the shaft. Preferably, a cotter pin is used behind nut 36 for additional safety.

While any suitable means may be used to secure the hoist assembly to a structure 38, the arrangement using a central cap screw 40, as shown, is preferred. The head of cap screw 40 is countersunk into lower plate 16 and is preferably locked in place, such as by small weld beads 42 and/or 44 to prevent rotation of the cap screw relative to the lower plate. If the use of more than one bolt to hold the assembly to a structure is desired, in place of cap screw 40, two or more of bolts 17 could be elongated and extend into structure 38. Or, additional bolts could be provided through housing 12 into structure 38 between bolts 17 in place of, or in addition to, cap screw 40. Unlike prior lift rings, this assembly retains full and unrestricted rotation and tilt ability even when two or more bolts 17 or the equivalent are used to fasten housing 12 to a structure 38.

In order to install assembly 10 onto a structure 38 to be lifted, threaded holes are provided in the structure conforming to the thread of cap screw 40. Capscrew 40 is threaded into the hole, then tightened by inserting removable rods 46 into holes 48 (one of which is shown in cut away in FIG. 1) in the edge of lower plate 16 and rotating assembly 10 until snug. Where structure 38 is relatively thin where the assembly 10 is to be installed, cap screw 40 could extend through a smooth hole in the structure and fastened by a suitable washer and nut on the structure side opposite the assembly.

Because of the sturdy design a given weight of the assembly, with a specific shackle size, will have a considerably higher lift load rating than will prior art designs using short shoulder pins, clip retainers and the like. In general, this assembly will have a cost about one-third that of comparable prior lift devices having similar load ratings.

Figure 4:
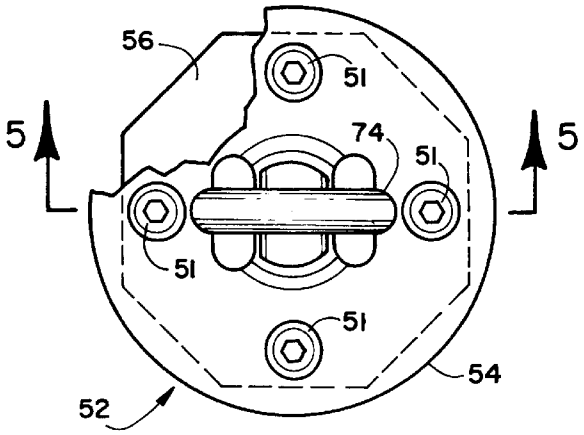
FIG. 4 is a plan view of a second embodiment of a universal hoist assembly.
Figure 5:
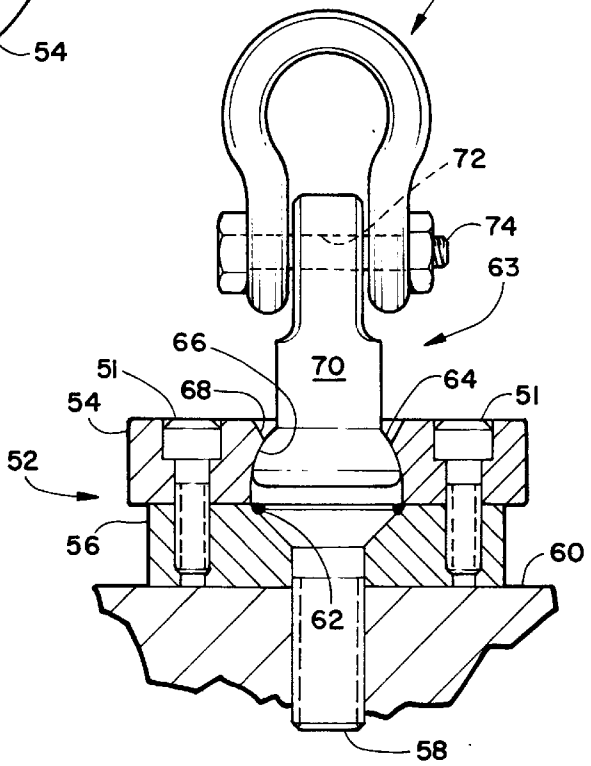
FIG. 5 is a section view of the assembly of FIG. 4, taken on line 5—5 in FIG. 4.

A second embodiment of the universal hoist ring is shown in FIGS. 4 and 5. Here, housing 52 includes an upper plate 54 and a lower plate 56, held together by bolts 51. A cap screw 58 extends through lower plate for fastening the assembly to a structure 60. A weld bead 62 or the like secures cap screw 58 to lower plate 56. For ease of installation, upper plate 54 is round and lower plate 56 is hexagonal (as seen in the cut away area in FIG. 4), so that a spanner may be placed against the lower plate to tighten the assembly onto surface 60. Alternately, where structure 60 is relatively thin, cap screw 58 could extend entirely through structure 60 and held in place by a washer 41 and nut 43, as illustrated in FIG. 5.

Lift swivel 63 in the embodiment of FIGS. 4 and 5 has a base 64 with a spherical exterior. The interior of upper plate 54 has a complementary spherical surface 66, so that swivel 64 may pivot to the limit of opening 68 in any direction. An upright extension 70 of base 64 has a transverse aperture 72 for receiving shaft 74 (here, a bolt) of shackle 76.

Figure 7:
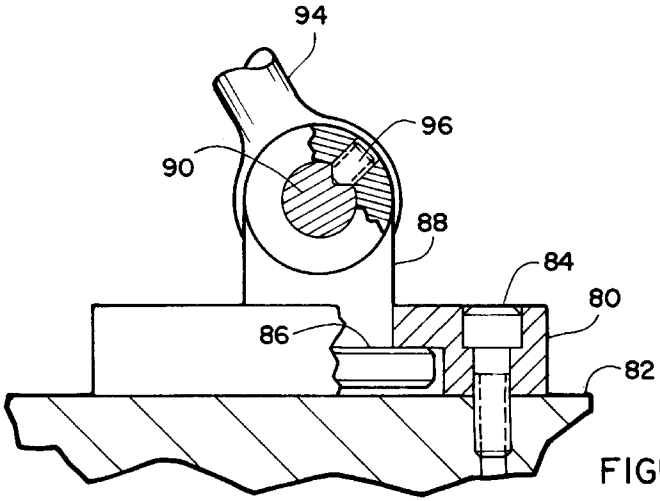
FIG. 7 is a side elevation view, partly cut-away, of the assembly of FIG. 6.
Figure 8:
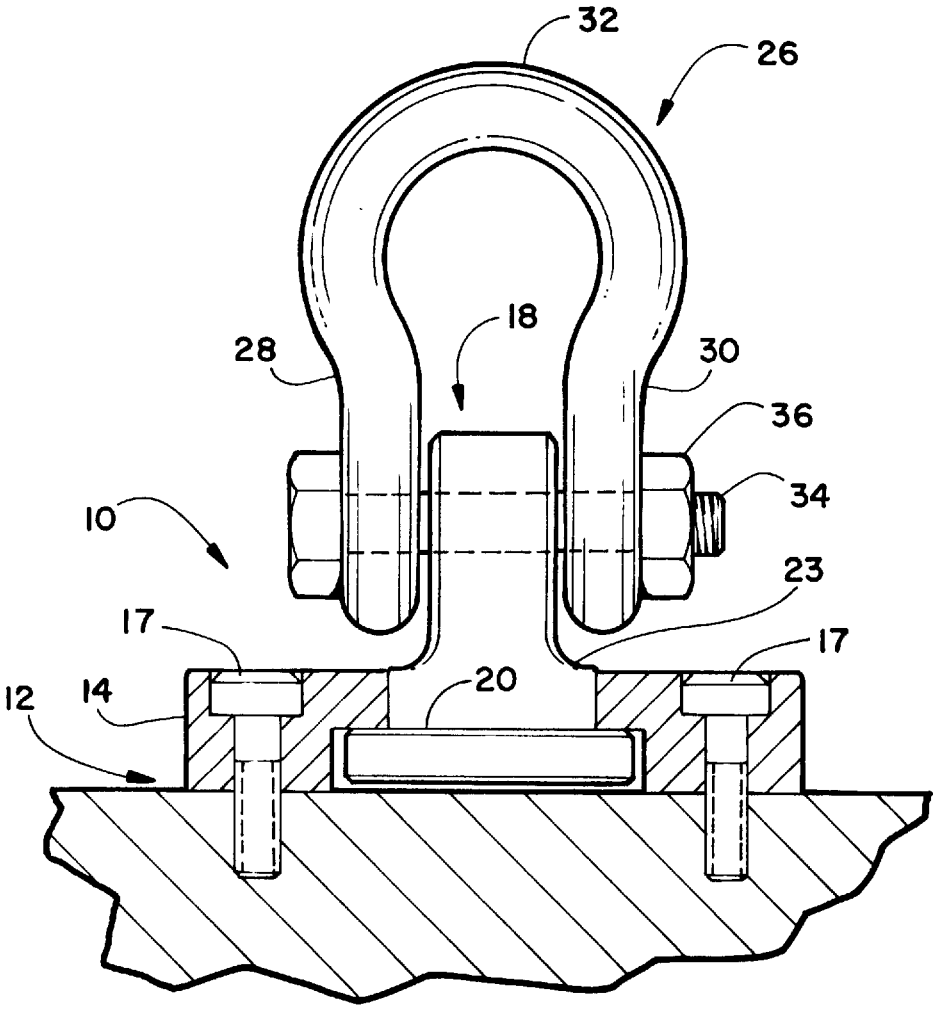
FIG. 8 is a side elevation view, partly cut away, of a fourth embodiment of the assembly.

While use of lower plate 56 and cap screw 58 is preferred for most applications, if more than one fastener between structure 60 and the hoist assembly is desired, plate 56 and cap screw 58 could be eliminated and machine bolts 51 could extend through upper plate 54 directly into threaded holes in structure 60. Or, additional bolts could be inserted through upper plate 54 into structure 60. As seen in FIGS. 7 and 8, when the lower plate is omitted, the upper plate 80 (FIG. 7) or upper plate 14 (FIG. 8) may be threaded directly into corresponding holds in the structure. FIG. 8 illustrates the embodiment of FIG. 2 with the lower plate 16 and cap screw 40 eliminated and cap screws 17 directly threaded into the support. All reference numbers in the FIG. 8 showing refer to the same components as detailed in conjunction with the description of the FIG. 2 embodiment.

The embodiment of FIGS. 4 and 5 provides greater flexibility, since shackle 76 can pivot, base 64 can rotate and base 64 further can pivot in any direction to a significant extent.

Figure 6:
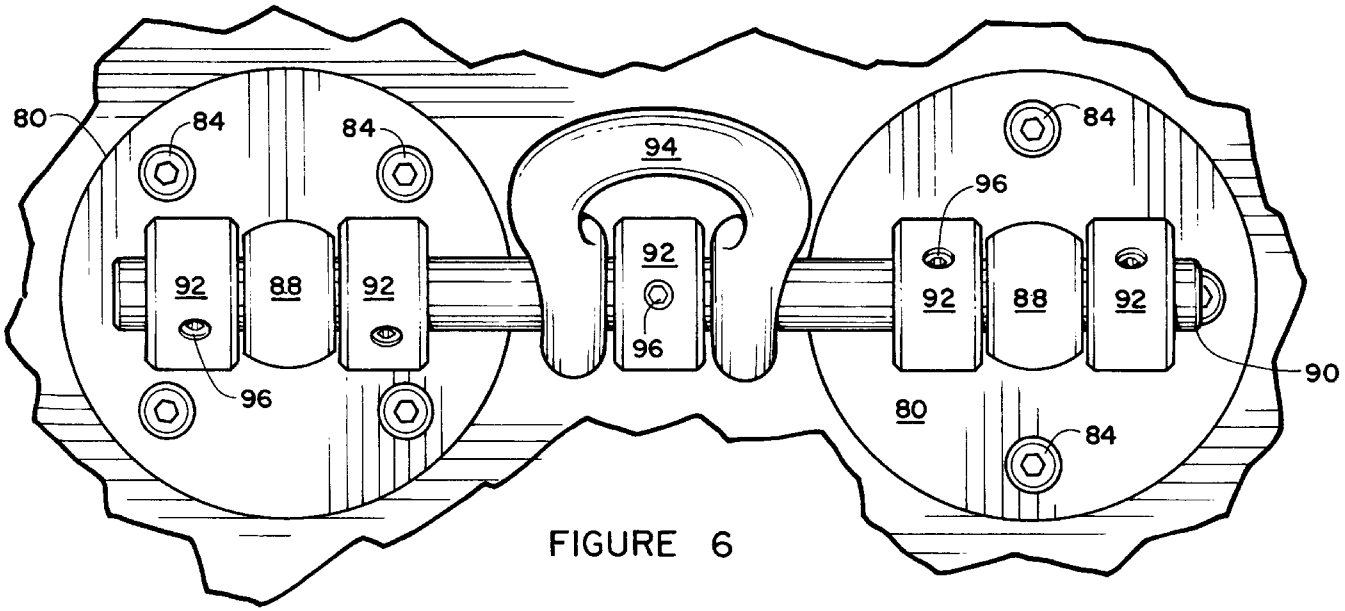
FIG. 6 is a plan view of a third embodiment of a universal hoist assembly.

A third embodiment, providing a higher strength attachment to a structure to be lifted is illustrated in FIGS. 6 and 7. This embodiment provides a further application for the components described above, in a hoist assembly that, in this case has two structure mounts and provides a shackle that pivots and does not rotate.

A pair of spaced plates 80, each of which is basically the same as upper plate 14 as shown in FIGS. 1–3, are fastened directly to a structure 82 by a plurality of machine bolts 84. If desired, rather than threading bolts 84 into the structure to be lifted, bolts 84 could extend through the structure and be secured by nuts at their distal ends. Alternately, a lower plate and cap screws of the sort shown in FIGS. 1–3 could be used with plate 80 to secure each assembly to structure 82.

Each plate 80 has an internal cavity sized to capture the base 86 of a lift swivel 88, basically identical to lift swivel 18 described above. An elongated shaft 90 is inserted through apertures in both lift swivels 88. The two plates 80 can be placed at any desired location on structure 82, reasonably close together. The apertures in lift swivels 88 are easily brought into alignment with shaft 90 by simply rotating the swivels. Shaft 90 is inserted through one lift swivel 88, then through a shaft collar 92, through one leg of a shackle 94, a second shaft collar 92, the other leg of shackle 94, a third shaft collar 92 and the second lift swivel 88. The positions of the shaft collars are adjusted to position the shaft and shackle, then setscrews 96 in each shaft collar 92 are tightened. While any selected number of setscrews may be used, four are preferred for maximum holding power. Finally, two more shaft collars 92 are placed over the ends of the shafts abutting lift swivels 88 and the setscrews are tightened in place. Any suitable type of setscrew may be used. Excellent results are obtained with cone, knurled cup and plain cup with locking elements such as the LocWel element. For optimum security, set screws having half dog ends (a reduced diameter cylindrical end) which fit into holes drilled in shaft 90.

The embodiment of FIGS. 6 and 7 uses the same components as the other embodiment and allows the lifting of heavy loads where optimum fastening of a single lift assembly to the structure is not possible, such as where the structure is formed from a softer metal, such as aluminum or the lift must be made at a relatively thin section. This embodiment allows shackle 94 to pivot in a plane perpendicular to the axis of shaft 90, but not to swivel.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A universal hoist assembly which comprises:

a housing;

said housing comprising an upper plate and a generally coextensive lower plate, said upper and lower plates secured together by a plurality of fasteners;

means fixed to said lower plate for securing said housing to a structure;

a lift swivel having a base captured in said housing and rotatable relative thereto;

said base being disk shaped and captured between opposed parallel faces of said upper plate and said lower plate for rotation in said housing;

a transversely apertured upright extension permanently secured to said base for rotation therewith and extending from said housing opposite said securing means;

a generally U-shaped shackle having first and second legs; and a shaft extending through said first leg, said transverse aperture and said second leg.

2. The universal hoist assembly according to claim 1 wherein bearing surfaces between said housing and said base are lubricated with a material selected from a group consisting of low friction washers, dry powdered lubricants and combinations thereof.

3. The universal hoist assembly according to claim 1 wherein said means for securing said housing to a structure comprises a single threaded member permanently fixed to said lower plate and rotatable with said lower plate to thread said member into a correspondingly threaded opening in a structure.

4. The universal hoist assembly according to claim 1 wherein said means for securing said housing to a structure comprises a single threaded member permanently fixed to said lower plate, rotatable with said lower plate and sized to extend through a hole in a structure wall and be secured by a distal end nut.

5. The universal hoist assembly according to claim 1 wherein said means for securing said housing to a structure comprises a plurality of bolts extending through said housing and individually threadable into correspondingly threaded openings in said structure.

6. A universal hoist assembly which comprises:

a housing;

said housing comprising an upper plate and a generally coextensive lower plate, said upper and lower plates secured together by a plurality of fasteners;

means for securing said housing to a structure comprises a single threaded member fixed to said lower plate and rotatable with said lower plate to thread said member into a correspondingly threaded opening in a structure;

a lift swivel having a base rotatable and pivotable in said housing;

said base having a generally spherical outer surface area;

said housing having a generally spherical inner recess area configured to receive said outer surface area;

a transversely apertured upright extension permanently fixed to said base for movement therewith and extending through an opening in said housing opposite said securing means;

a generally U-shaped shackle having first and second legs; and a shaft extending through said first leg, said transverse aperture and said second leg.

7. The universal hoist assembly according to claim 6 wherein bearing surfaces between said housing and said base are lubricated with a material selected from a group consisting of low friction washers, dry powdered lubricants and combinations thereof.

8. The universal hoist assembly according to claim 6 wherein said means for securing said housing to a structure comprises a single threaded member permanently fixed to said lower plate, rotatable with said lower plate and sized to extend through a hole in a structure wall and be secured by a distal end nut.

9. A universal hoist assembly which comprises:

first and second housings;

means for securing said housings to a structure in a spaced relationship;

two lift swivels, each having a base captured in one of said first and second housings and rotatable relative thereto;

a transversely apertured upright extension connected to each said base for rotation therewith and extending from each said housing opposite said securing means;

a generally U-shaped shackle having first and second legs; and a shaft extending through both legs of said shackle and both, said transverse apertures with said shackle positioned between said first and second housings; and a plurality of shaft collars along said shaft to position said shaft, shackle and first and second housings relative to each other.

10. The universal hoist assembly according to claim 9 wherein said means for securing each said housing to a structure comprises a plurality of bolts extending through each said housing and individually threadable into correspondingly threaded openings in said structure.

11. The universal hoist assembly according to claim 9 wherein each said housing comprises an upper plate having a recess for receiving said base and an opening through which said upright extension projects and a lower plate closing said recess.

12. A universal hoist assembly which comprises:

a housing;

said housing comprising an upper plate and a generally coextensive lower plate, said upper and lower plates secured together by a plurality of fasteners;

said means for securing said housing to a structure comprising a single threaded member fixed to said lower plate and rotatable with said lower plate to thread said member into a correspondingly threaded opening in a structure;

a lift swivel having a base captured in said housing and rotatable relative thereto;

a transversely apertured upright extension permanently secured to said base for rotation therewith and extending from said housing opposite said securing means;

a generally U-shaped shackle having first and second legs; and a shaft extending through said first leg, said transverse aperture and said second leg.

13. The universal hoist assembly according to claim 12 wherein bearing surfaces between said housing and said base are lubricated with a material selected from a group consisting of low friction washers, dry powdered lubricants and combinations thereof.

14. The universal hoist assembly according to claim 12 wherein said base has a generally spherical outer surface captured in a corresponding recess in said housing to allow said lift swivel to pivot in any direction.

15. A universal hoist assembly which comprises:

a housing;

said housing comprising an upper plate and a generally coextensive lower plate, said upper and lower plates secured together by a plurality of fasteners;

means for securing said housing to a structure comprising a single threaded member fixed to said lower plate, rotatable with said lower plate and sized to extend through a hole in a structure wall and be secured by a distal end nut;

a lift swivel having a base captured in said housing and rotatable relative thereto;

a transversely apertured upright extension permanently secured to said base for rotation therewith and extending from said housing opposite said securing means;

a generally U-shaped shackle having first and second legs; and a shaft extending through said first leg, said transverse aperture and said second leg.

16. The universal hoist assembly according to claim 15 wherein bearing surfaces between said housing and said base are lubricated with a material selected from a group consisting of low friction washers, dry powdered lubricants and combinations thereof.

17. The universal hoist assembly according to claim 15 wherein said base has a generally spherical outer surface captured in a corresponding recess in said housing to allow said lift swivel to pivot in any direction.

18. A universal hoist assembly which comprises:

a housing;

said housing comprising an upper plate and a generally coextensive lower plate, said upper and lower plates secured together by a securing means comprising a plurality of bolts;

said bolts extending beyond said lower plate for threading into corresponding threaded holes in a structure;

a lift swivel having a base captured in said housing and rotatable relative thereto;

a transversely apertured upright extension permanently secured to said base for rotation therewith and extending from said housing opposite said securing means;

a generally U-shaped shackle having first and second legs; and a shaft extending through said first leg, said transverse aperture and said second leg.

19. The universal hoist assembly according to claim 18 wherein said base is disk shaped and captured between opposed parallel faces of said upper plate and said lower plate for rotation in said housing.

* * * * *